US005078895A

United States Patent [19]

Dany et al.

[11] Patent Number: 5,078,895

[45] Date of Patent: Jan. 7, 1992

[54] WASHING AGENT WITH STORAGE-STABILIZED BLEACH SYSTEM

[75] Inventors: Franz-Josef Dany, Erftstadt; Werner Gohla, Niederkassel; Günther Schimmel, Erftstadt, all of Fed. Rep. of Germany; Hans P. Rieck, Tokyo, Japan; Ingrid Czeslik, Kerpen, Fed. Rep. of Germany

[73] Assignee: Hoechst Aktiengesellschaft, Frankfurt am Main, Fed. Rep. of Germany

[21] Appl. No.: 627,884

[22] Filed: Dec. 13, 1990

Related U.S. Application Data

[63] Continuation of Ser. No. 331,255, Mar. 30, 1989, abandoned.

[30] Foreign Application Priority Data

Apr. 15, 1988 [DE] Fed. Rep. of Germany ..... 3812556

[51] Int. Cl.[5] ..... C11D 3/02; C11D 3/12; C11D 3/395; C11D 7/56

[52] U.S. Cl. ..... 252/94; 252/95; 252/99; 252/102; 252/140; 252/174.25

[58] Field of Search ..... 252/95, 99, 102, 174.25, 252/140, 94

[56] References Cited

U.S. PATENT DOCUMENTS

| | | | |
|---|---|---|---|
| 4,597,886 | 7/1986 | Goedhart et al. | 252/95 |
| 4,664,839 | 5/1987 | Rieck | 252/175 |
| 4,680,131 | 7/1987 | Busch et al. | 252/102 |
| 4,728,443 | 3/1988 | Rieck et al. | 252/8.6 |
| 4,737,304 | 4/1988 | Wichelhaus et al. | 252/95 |
| 4,839,066 | 6/1989 | von Rybinski et al. | 252/8.75 |
| 4,861,510 | 8/1989 | Wilms et al. | 252/174.13 |
| 4,950,310 | 8/1990 | Rieck et al. . | |

FOREIGN PATENT DOCUMENTS

| | | |
|---|---|---|
| 0028432 | 5/1981 | European Pat. Off. . |
| 0263520 | 4/1988 | European Pat. Off. . |
| 0320770 | 6/1989 | European Pat. Off. . |
| 220325 | 3/1985 | German Democratic Rep. . |
| 220326 | 3/1985 | German Democratic Rep. . |
| 220328 | 3/1985 | German Democratic Rep. . |

*Primary Examiner*—Paul Lieberman
*Assistant Examiner*—Erin M. Higgins
*Attorney, Agent, or Firm*—Connolly & Hutz

[57] ABSTRACT

The invention relates to a washing agent with a storage-stabilized bleach system and 2 to 20% by weight of detergents and conventional washing auxiliaries, including fillers, the washing agent containing 10 to 50% by weight of a crystalline layered silicate as a builder as well as 1 to 5% by weight of tetraacetylethylenediamine (TAED) and a bleach, the quantity of bleach being such that 0.5 to 4% by weight of washing-active oxygen (AVOX) is present in the washing agent.

13 Claims, No Drawings

WASHING AGENT WITH STORAGE-STABILIZED BLEACH SYSTEM

This application is a continuation of application Ser. No. 07/331,255, filed Mar. 30, 1989, abandoned.

The present invention relates to a washing agent with a storage-stabilized bleach system and 2 to 20% by weight of detergents and conventional washing auxiliaries, including fillers, in particular to a domestic washing agent for heavy laundry, white laundry and colored laundry, as is used in washing machines Due to the increasingly wide use of domestic washing machines, the washing agent must be adapted to the changed washing conditions.

Modern washing agents are therefore composed of a com-bination of detergents as the washing-active substances, bleaches and additives which boost the washing power, the so-called builders which, on the one hand, eliminate the hardness of the washing liquor and, on the other hand, prevent depositions of inorganic salts on the material being washed and thereby ensure a "soft handle" of the washed material after the washing process.

Polymeric phosphates, in particular sodium tripolyphosphate, are regarded as excellent builders. Because of the danger of eutrophication of rivers and lakes by the phosphate content in domestic effluents, the use of zeolites as a builder has been proposed.

It has been found that the use of zeolites as a builder has the disadvantages that the washed material loses the desired "soft handle" in the course of a plurality of washing steps. A further point is that, during the storage time between the production and the consumption of the washing agent, the washing agent loses part of its washing power by decomposition of the bleach.

It has therefore been proposed in U.S. Pat. No. 4,728,443 to add to the washing agent an additional 1 to 20% by weight of crystalline layered silicate or alkali metal silicate. In this way, it was possible to achieve a "soft handle" of the washed material even if zeolites were used as the builders; however, the storage stability of the washing agent was not affected thereby.

It is the object of the invention to provide a washing agent with a storage-stabilized bleach system, which has a boosted bleach action on the washed material and maintains the "soft handle" in the washed material.

Surprisingly, it has been found that a washing agent with a storage-stabilized bleach system is obtained when it contains 10 to 50% by weight, in particular 20 to 35% by weight, of a crystalline layered silicate as the builder and 1 to 5% by weight, in particular 2.0 to 3.0% by weight, of tetraacetylethylenediamine (TAED) and a bleach, the quantity of bleach being such that 0.5 to 4% by weight, in particular 1.0 to 2.5% by weight, of washing-active oxygen (AVOX) is present in the washing agent.

A crystalline layered silicate of the general formula $$NaMSi_XO_{2+1} \times Y\ H_2O$$

where

X = 1.9 to 4.0,

M = Na or H and

Y = 0 to 20 has proved particularly suitable. Very particularly good results are obtained when the crystalline layered silicate corresponds to the modification of $Na_2Si_2O_5$.

Further preferred and selective features of the washing agent according to the invention can be that a) the crystalline layered silicate has a particle diameter from 0.01 to 1,000 μm, in particular from 1 to 20 μm, b) the crystalline layered silicate has an ion exchange capacity from 400 to 1,200 mmol of $Na^+$/100 g of dry matter, c) the bleach is sodium perborate tetrahydrate, sodium perborate monohydrate and/or sodium percarbonate, d) it contains inorganic and/or organic phosphates, borates, citrates, gluconates, nitrilotriacetic acid and/or iminodiacetates as additional builders in quantities of up to 20% by weight, e) it is composed of agglomerate particles having a particle size in the range from 0.25 to 2.5 mm and was obtained by a spray-mist mixing process, f) it contains, as the detergent, alkali metal salts of alkylbenzenesulfonates, higher alkylsulfonates and/or higher fatty alcohol polyethoxylate-sulfates, in particular with alkyl radicals having 10 to 18 carbon atoms on average in the alkyl group, and g) it contains carboxymethylcellulose, carboxymethyl starch and/or methylcellulose in quantities of up to 10% by weight as a washing auxiliary.

The crystalline layered silicates used in the production of the washing agent according to the invention can be prepared according to U.S. Pat. No. 4,664,839.

The washing-active oxygen (AVOX) of the bleach and of the washing agent was determined in accordance with the instructions by Dr. E. Heinerth, Tenside 2 (1965) 180. The sodium perborate tetrahydrate ($NaBO_3 \times 4\ H_2O$) investigated had an AVOX number of 10% by weight; sodium perborate monohydrate ($NaBO_3 \times H_2O$) had an AVOX number of 15% by weight and sodium percarbonate ($2\ Na_2CO_3 \times 3\ H_2O_2$) had an AVOX number of 13.5% by weight.

The washing power (bleach action) of the washing agent was determined as the whiteness of the test fabrics (WFK polyester/cotton soiled by tea, order code 20 G) according to DIN 44983.

The washing power (bleach action) of the washing liquor was determined by the difference method which follows from equation I $$\%\ WK = \%\ WG_g - \%\ WG_b$$

where:

% WK = % washing power (bleach action)

% $WG_g$ = % whiteness of the washed material

% $WG_b$ = % whiteness of the unwashed material.

The storage tests were carried out under the following forced test conditions:

The washing agent to be investigated was stored in a conditioned cabinet at a relative atmospheric humidity of 70% at a temperature of 37° C. During the test, the washing agent was packed in a waxed carton. The water vapor permeability of the packaging was 0.4 $g/m^2 \times h$.

The tested washing agent formulations are listed in Table 1.

The degradation values of the bleach as a function of the time after the forced storage test conditions are compiled in Table 2. In addition, two commercially available washing agents based on zeolite and sodium tripolyphosphate were included in Table 2. The degradation of bleach, in particular that of sodium percarbonate, is very high in the presence of zeolite.

The test results according to DIN 44983 for the various washing agent formulations, as determined in accordance with equation I, are listed in Table 3.

The test values show that the bleach action is enhanced when a crystalline layered silicate is used as the builder in place of zeolite. In the presence of TAED, the washing power (bleach action) of the washing agent is boosted synergistically.

The assessment of handle by a panel of experts gave a markedly "softer handle" of the washed material, which had been washed with the washing agents according to the invention in accordance with Examples 2 and 3, as compared with the washed material which had been washed with the zeolite-containing washing agent in accordance with Examples 1 and 4.

TABLE 1

| Ingredients (% by weight) | Washing agent formulations Example 1 | Example 2* | Example 3* | Example 4 | Example 5 |
|---|---|---|---|---|---|
| Anionic surfactants | 6.5 | 6.5 | 6.5 | 6.5 | 6.5 |
| Nonionic surfactants | 3.5 | 3.5 | 3.5 | 3.5 | 3.5 |
| Soap | 4.5 | 4.5 | 4.5 | 4.5 | 4.5 |
| Zeolite A | 21.5 | — | — | 21.5 | — |
| $\delta$-$Na_2Si_2O_5$ | — | 21.5 | 21.5 | — | 21.5 |
| Soda | 7.5 | — | — | 7.5 | — |
| $NaCO_3 \times H_2O$ | 10.0 | 10.0 | — | — | — |
| TALD | 2.5 | 2.5 | 2.5 | — | — |
| $2\ Na_2CO_3 \times 3\ H_2O_2$ | — | — | 18.0 | 18.0 | 18.0 |
| Optical brighteners | 0.2 | 0.2 | 0.2 | 0.2 | 0.2 |
| Soil carriers | 1.5 | 1.5 | 1.5 | 1.5 | 1.5 |
| Enzymes | 0.3 | 0.3 | 0.3 | 0.3 | 0.3 |
| Dispersants (polycarboxylates) | 4.0 | 2.0 | — | 4.0 | 2.0 |
| Na silicate | 5.0 | — | — | 5.0 | — |
| Extender ($Na_2SO_4$) | | | to 100% | | |

*Washing agent according to the invention

TABLE 2

| Example | AVOX degradation: AVOX degradation in % 1 week | 2 weeks | 3 weeks |
|---|---|---|---|
| 1 | 14 | 29 | 32 |
| 2* | 0 | 9 | 11 |
| 3* | 0 | 5 | 9 |
| 4 | 33 | 50 | 86 |
| 5 | 0 | 4 | 8 |
| Zeolite-based commercial material | 16 | 22 | 37 |
| $Na_5P_3O_{10}$-based commercial material | 0 | 16 | 21 |

*washing agent according to the invention

TABLE 3

| Example | Bleach action, determined in accordance with equation I: % Washing power |
|---|---|
| 1 | 37.5 |
| 2* | 43.0 |
| 3* | 42.0 |
| 4 | 31.5 |
| 5 | 38.5 |

*washing agent according to the invention

We claim:

1. A storage-stabilized washing agent free from zeolites and containing a building and a bleach, said agent comprising:

10–50% by weight of a crystalline layered silicate as the building, a quantity of the bleach selected such that 0.5–4% by weight of washing-active oxygen is present in the washing agent;

1–5% by weight tetraacetylethylenediamine, and

2–20% by weight of an additional washing component which includes a detergent.

2. The washing agent as claimed in claim 1, containing 20 to 35% by weight of a crystalline layered silicate as the builder.

3. The washing agent as claimed in claim 1, containing 2.0 to 3.0% by weight of tetraacetylethylenediamine.

4. The washing agent as claimed in claim 1, wherein the bleach quantity is such that 1.0 to 2.5% by weight of washing-active oxygen is present in the washing agent.

5. The washing agent as claimed in claim 1, wherein the crystalline layered silicate is of the formula $$NaMSi_xO_{2x+1} \times Y\ H_2O$$

where

X=1.9 to 4.0

M=Na or H and

Y=0 to 20.

6. The washing agent as claimed in claim 1, wherein the crystalline layered silicate has a particle diameter from 0.01 to 1,000 $\mu$m.

7. The washing agent as claimed in claim 1, wherein the crystalline layered silicate has a particle diameter from 1 to 20 $\mu$m.

8. The washing agent as claimed in claim 1, wherein the crystalline layered silicate has an ion exchange capacity from 400 to 1,200 mmol of $Na^+$/100 g of dry matter.

9. The washing agent as claimed in claim 1, containing up to 20% by weight of an additional builder selected from the group consisting of inorganic phosphates, organic phosphates, borates, citrates, gluconates, nitrilotriacetic acid (NTA), iminodiacetates or mixtures thereof.

10. The washing agent as claimed in claim 1, composed of agglomerate particles having a particle size in the range from 0.25 to 2.5 mm and obtained by means of a spray-mist mixing process.

11. The washing agent as claimed in claim 1, wherein the bleach is selected from the group consisting of sodium perborate tetrahydrate, sodium perborate monohydrate, sodium percarbonate or mixtures thereof.

12. A storage-stabilized washing agent as claimed in claim 11, wherein said additional component includes both a detergent and an additional builder.

13. A storage-stabilized washing agent as claimed in claim 11, wherein the crystalline layered silicate is $\delta$-$Na_2Si_2O_5$.

* * * * *